United States Patent [19]

Pryor et al.

[11] Patent Number: 4,889,143

[45] Date of Patent: Dec. 26, 1989

[54] CIGARETTE RODS AND FILTERS CONTAINING STRANDS PROVIDED FROM SHEET-LIKE MATERIALS

[75] Inventors: James W. Pryor, Winston-Salem; Mark L. Raker, Clemmons; Andrew J. Sensabaugh, Jr., Winston-Salem; Henry A. Hauser, Hamptonville, all of N.C.

[73] Assignee: R. J. Reynolds Tobacco Company, Winston-Salem, N.C.

[21] Appl. No.: 863,222

[22] Filed: May 14, 1986

[51] Int. Cl.[4] ..... A24D 1/00; A24D 3/00

[52] U.S. Cl. ..... 131/331; 131/361

[58] Field of Search ..... 131/331, 342, 344, 361, 131/353, 375, 370

[56] References Cited

U.S. PATENT DOCUMENTS

| | | | |
|---|---|---|---|
| 2,001,709 | 5/1935 | Davidson . | |
| 2,039,298 | 5/1936 | Davidson . | |
| 2,158,928 | 5/1938 | Deich . | |
| 2,164,702 | 7/1939 | Davidson . | |
| 2,168,474 | 8/1939 | Davidson . | |
| 2,190,107 | 2/1940 | Pohle . | |
| 2,202,839 | 6/1940 | Davidson . | |
| 2,669,995 | 2/1954 | Troy . | |
| 2,785,681 | 3/1957 | Fessler . | |
| 2,792,006 | 5/1957 | Marek . | |
| 2,804,874 | 9/1957 | Visnick . | |
| 2,849,932 | 9/1958 | Marogg . | |
| 2,852,987 | 9/1958 | Schanz . | |
| 2,900,989 | 8/1959 | Davidson . | |
| 2,948,282 | 8/1960 | White | 131/342 |
| 2,992,648 | 7/1961 | Weiss . | |
| 3,046,994 | 7/1962 | Schur . | |
| 3,084,697 | 4/1963 | Eissmann . | |
| 3,101,723 | 8/1963 | Seligman et al. . | |
| 3,119,396 | 1/1964 | Tanquary . | |
| 3,219,041 | 11/1965 | Bromberg . | |
| 3,230,958 | 1/1966 | Dearsley . | |
| 3,251,365 | 5/1966 | Keith et al. . | |
| 3,299,895 | 1/1967 | Dearsley . | |
| 3,304,944 | 2/1967 | Badertscher . | |
| 3,319,630 | 5/1967 | Orrmins . | |
| 3,320,960 | 5/1967 | Molins . | |
| 3,353,543 | 11/1967 | Sproull et al. . | |
| 3,361,139 | 1/1968 | Inoue . | |
| 3,368,566 | 2/1968 | Avedikian | 131/344 |
| 3,395,713 | 8/1968 | Ent-Keller . | |
| 3,428,050 | 2/1969 | Kandel . | |
| 3,516,417 | 6/1970 | Moses . | |
| 3,589,373 | 6/1971 | Hooper . | |
| 3,713,451 | 1/1973 | Bromberg . | |
| 3,841,338 | 10/1974 | Horsewell et al. . | |
| 3,858,587 | 1/1975 | Cavelli et al. . | |
| 3,875,949 | 4/1975 | Harendza-Harinxma et al. . | |
| 3,900,037 | 8/1975 | Horsewell et al. . | |
| 3,933,160 | 1/1976 | Gerardy . | |
| 4,125,061 | 11/1978 | Goavec . | |
| 4,219,031 | 8/1980 | Rainer et al. . | |
| 4,291,711 | 9/1981 | Berger . | |
| 4,355,995 | 10/1982 | Berger . | |
| 4,391,285 | 7/1983 | Burnett et al. . | |
| 4,411,391 | 10/1983 | Crane . | |
| 4,488,563 | 12/1984 | Morifuji et al. . | |
| 4,489,897 | 12/1984 | Turner et al. . | |
| 4,495,456 | 1/1985 | Vercillo et al. . | |
| 4,632,131 | 12/1986 | Burnett et al. . | |

*Primary Examiner*—V. Millin

*Attorney, Agent, or Firm*—August J. Borschke

[57] ABSTRACT

Rods are manufactured by shredding strips of sheet-like reconstituted tobacco material into a plurality of strands of about 1/32 inch width. The strands are gathered into a rod-like shape and circumscribed by paper wrap in order to provide a continuous rod. The continuous rod is severed at regular intervals to provide a plurality of rods of the desired length. The resulting rods have a plurality of substantially longitudinally extending strands provided from shredded sheet-like material. The rods are useful as cigarette rods or in the manufacture of cigarette filter elements.

27 Claims, 3 Drawing Sheets

CIGARETTE RODS AND FILTERS CONTAINING STRANDS PROVIDED FROM SHEET-LIKE MATERIALS

BACKGROUND OF THE INVENTION

This invention relates to smoking articles such as cigarettes, and in particular to smoking articles having longitudinally extending strands provided from sheet-like materials.

Popular smoking articles such as cigarettes have a substantially cylindrical rod shaped structure which includes a charge of smokable material such as tobacco surrounded by a wrapper such as paper. It has become desirable to manufacture cigarettes having filters constructed from fibrous materials such as cellulose acetate. Such filters can provide unique taste characteristics to cigarettes as well as preventing tobacco particles from being drawn into the smoker's mouth during use of the cigarette.

Conventional methods for making cigarette filters involve the forming of rods from a source of cellulose acetate filter tow. Exemplary methods and apparatus are disclosed in U.S. Pat. Nos. 3,741,846; 4,132,189 and 4,283,998 to Greve et al.

Filter and mouthpiece elements for cigarettes containing tobacco materials have been proposed in U.S. Pat. Nos. 2,190,107 to Pohle; 2,792,006 to Marek; 2,804,874 to Visnick; 2,948,282 to White; 3,046,994 to Schur; 3,101,723 to Seligman et al; 3,219,041 to Bromberg; 3,428,050 to Kandel; 3,368,566 to Avedikian; 3,858,587 to Cavelli; 3,353,543 to Sproull et al; 3,361,139 to Inove; 3,713,451 to Bromberg; and 4,291,711 to Berger.

Filter elements containing creped paper are proposed in U.S. Pat. Nos. 3,251,365 to Keith et al; 3,900,037 to Horsewell et al; 3,320,960 to Molins; 2,669,995 to Troy; and 3,875,949 to Harendza-Harinxma et al.

Filter elements having spirally wound materials are proposed in U.S. Pat. Nos. 2,992,648 to Weiss; and 2,785,681 to Fessler. A filter element proposed in U.S. Pat. No. 4,488,563 to Morifugi et al includes fiber tow having a corrugated sheet wound therearound such that the grooves of the corrugated sheet extend in the longitudinal direction of the filter element. A cigarette filter element containing absorbent paper which is wound or folded substantially parallel to the longitudinal axis of the cigarette is proposed in U.S. Pat. No. 3,933,160 to Gerady.

In U.S. Pat. No. 3,395,713 to Ent-Keller a filter element having corrugated or spirally shaped longitudinally extending paper membrane is proposed. A plurality of metal containing heat absorbing ribbons extend through a cigarette filter cartridge as proposed in U.S. Pat. No. 3,304,944 to Badertscher.

Many of the previously disclosed filter elements have not achieved any substantial commercial acceptance. The apparent absence of filter elements (other than those manufactured from cellulose acetate) from the marketplace may be due to a variety of factors. For example, cigarettes having such filter elements may be difficult or expensive to manufacture, or exhibit a poor or off taste.

It would be highly desirable to provide a smoking article such as a cigarette exhibiting the desirable characteristics of a filter cigarette while providing the user with a unique tobacco taste. In particular, it would be desirable to efficiently and effectively produce a unique filter element. In addition, it would be highly desirable to efficiently and effectively provide unique cigarette rods.

SUMMARY OF THE INVENTION

This invention relates to an apparatus for producing rods having a plurality of substantially longitudinally extending strands provided from sheet-like material, which strands are contained in a circumscribing wrapping material, the apparatus comprising:

(a) means for providing a plurality of substantially aligned continuous strands from at least one strip of sheet-like material;

(b) means for receiving and forming the substantially aligned strands into a rod-like shape thereby forming a rod-like composite wherein the strands are aligned in a substantially longitudinally extending manner;

(c) means for circumscribing the rod-like composite with wrapping material thereby forming a continuous rod; and (d) means for subdividing the continuous rod into a plurality of rods.

In another aspect, this invention relates to a process for producing rods having a plurality of substantially longitudinally extending strands provided from sheet-like material, which strands are contained in a circumscribing wrapping material, the process comprising the steps of:

(a) providing a plurality of substantially aligned continuous strands from at least one strip of sheet-like material; and then (b) receiving and forming the substantially aligned strands into a rod-like shape thereby forming a rod-like composite wherein the strands are aligned in a substantially longitudinally extending manner; and then (c) circumscribing the rod-like composite with wrapping material thereby forming a continuous rod; and then (d) subdividing the continuous rod into a plurality of rods.

In another aspect, this invention relates to a rod suitable as a cigarette rod or suitable for the preparation of cigarette filter elements. The rod includes a plurality of strands provided from sheet-like material. The strands extend generally along the longitude of the rod and are contained in a circumscribing wrap.

In yet another aspect, this invention relates to a substantially cylindrical cigarette filter element or plug having a filter medium and a circumscribing wrap covering the longitudinally extending surface of the filter medium such that the ends of the filter element are open to permit the passage of air and smoke therethrough. The filter medium includes a plurality of strands provided from sheet-like material. The strands extend generally along the longitude of the filter element.

In still another aspect, this invention relates to a cigarette comprising a substantially cylindrical rod of smokable material axially aligned with and attached to one end of the aforementioned filter element.

The apparatus and process of this invention allow for the efficient and effective preparation of consistent quality rods for use in the manufacture of cigarettes. For example, sheet-like tobacco-containing material can be employed in providing the aforementioned strands, and the subsequently provided rods can be used as cigarette rods. Alternatively, such rods can be employed in the manufacture of cigarette filter elements. Of particular interest is the fact that tobacco-containing filter elements, when employed as filter elements for filter cigarettes, are capable of providing the user of such a cigarette with a unique tobacco taste. Also of interest is the fact that the structure of the tobacco-containing filter elements of this invention are such that the resulting filter elements exhibit good firmness and integrity. Thus, the discomfort associated with tobacco particles being drawn into the cigarette user's mouth is minimized or eliminated under conditions of normal use. As a consequence, the tobacco-containing filter elements provide a suitable mouthpiece for cigarettes.

DETAILED DESCRIPTION OF THE EMBODIMENTS

Figure 1:
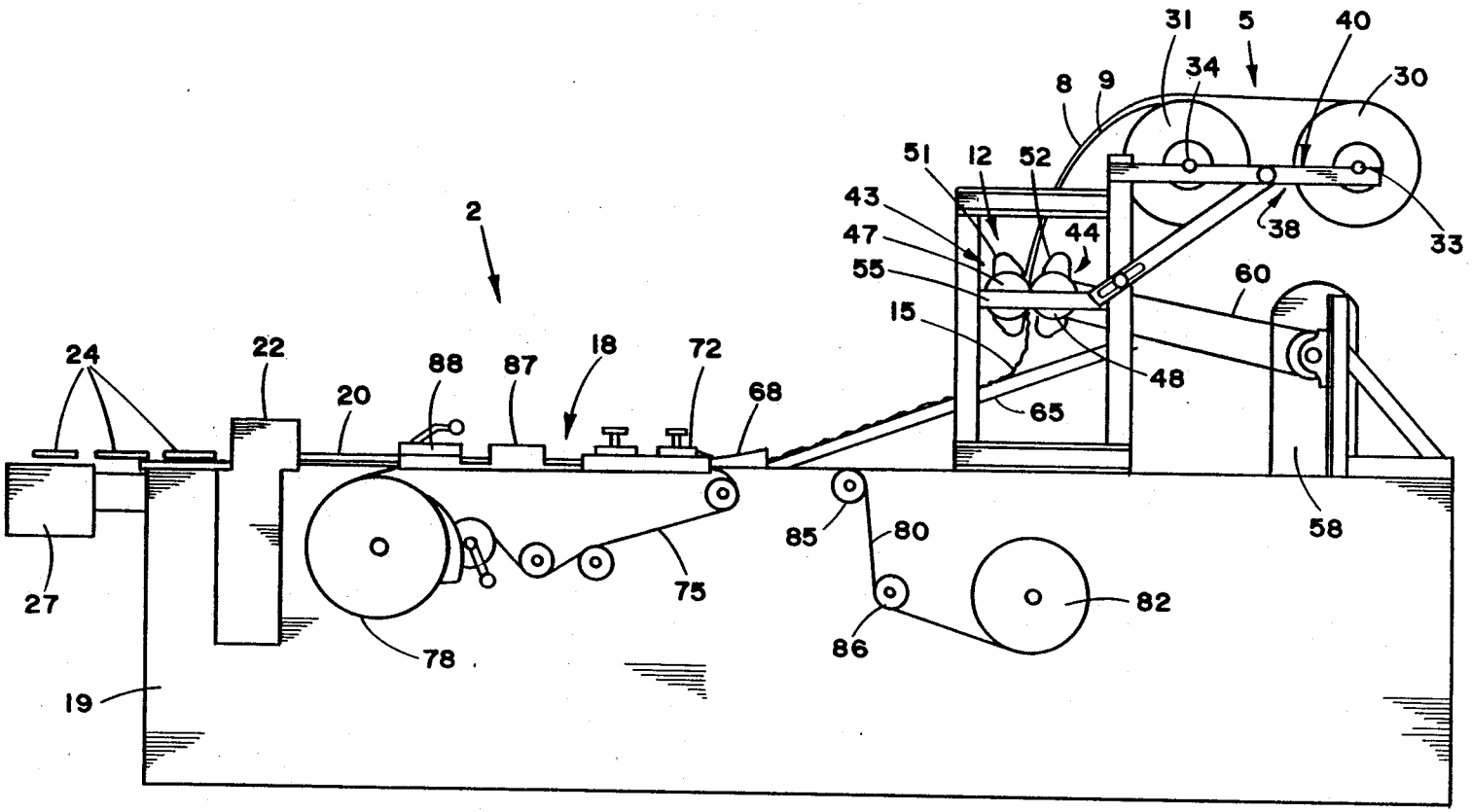
FIG. 1 is a diagrammatic illustration of one embodiment of the rod-making apparatus including the source of sheet-like material, the shredding means for forming strands of shredded material, and the rod-forming unit.

As used herein, by the term "sheet-like" is meant that the material is in a configuration or form wherein the width and length thereof are substantially greater than the thickness thereof. By the term "strip" is meant that the material in sheet-like form is in a configuration or form wherein the longitudinally extending length thereof is substantially greater than the width thereof. Preferably, a strip or web of sheet-like material is provided in roll form. By the term "strand" is meant that the material is in a configuration or form wherein the longitudinally extending length thereof is substantially greater than both the width and thickness thereof, and the width thereof is substantially less than that of the strip from which the strand is formed.

The appearance, composition and properties of the sheet-like material can vary. The color of the sheet-like material can be any color or range of colors desired. For example, the sheet-like material can be white, yellow or brown. Generally, the dry tensile strength of the sheet-like material is greater than about 3 pounds per 27 mm, preferably greater than about 4 pounds per 27 mm as determined using a Thwing Albert Model No. QC II Tensile Tester. Most preferably, the sheet-like material is a nonwoven, fibrous material such as is produced using a papermaking type process. For example, the fibrous sheet-like material is a felted or matted sheet of fibers. Most desirably, the fibers are provided from natural materials such as wood, tobacco, grains, flax, and the like, as well as combinations thereof.

It is particularly desirable to employ a tobacco-containing sheet-like material such as reconstituted tobacco. Of particular interest are reconstituted tobacco materials containing greater than about 50 percent, preferably greater than about 65 percent by weight of tobacco; and less than about 50 percent, preferably less than about 35 percent by weight of cellulose (i.e., wood) pulp. If desired, such reconstituted tobacco materials can contain binders and/or fillers such as clays, calcium carbonate, or the like. It is particularly desirable to employ a reconstituted tobacco material having greater than about 30 percent by weight of tobacco character extractables determined according to U.S. Alcohol, Tobacco and Firearms (ATF) Procedure 73-5. Typically, basis weight of suitable reconstituted tobacco materials range from about 30 to about 50, preferably about 40 to about 50 grams per square meter of sheet, as determined using TAPPI Standard T 410. In order to prevent shrinkage of rods of this invention, it is desirable to employ strips of reconstituted tobacco materials having a moisture content of less than about 15 percent, preferably from about 5 to about 14 percent, more preferably from about 6 to about 13 percent, most preferably from about 7 to about 12 percent. By the term "moisture content" is meant the percent weight loss of the filler material after heating the material at 220° F. for 5 minutes.

The thickness of the sheet-like material can vary, and typically is dependent upon the composition and strength of the material, the desired properties of strand which ultimately is provided, and other such factors. Generally, the thickness of a particular strip of sheet-like material is sufficient to provide a suitable strength during the processing stages thereof, and ultimately to provide a rod capable of exhibiting the desired properties. Generally, the thickness of the sheet-like material ranges from about 0.001 inch to about 0.05 inch, preferably from about 0.003 inch to about 0.01 inch, more preferably from about 0.003 inch to about 0.006 inch.

The width of the strand can vary, and is typically dependent upon the manner in which the sheet-like material is shredded to form the strand, the desired properties of the strand, and other such factors. For example, it is desirable to provide strands having widths which are not so narrow as to exhibit poor strengths, have a tendency to break, or have a tendency to become entangled to an undesirable degree upon formation in the shredding apparatus. Conversely, for example, it is desirable to provide strands which are not so wide in order that, when employed for the manufacture of a filter element, such strands can provide a filter element having desirable pressure drop (i.e., resistance to draw) values, an acceptable appearance, and an acceptable filtration efficiency. Typically, strips of sheet-like material of relatively great thickness can be shredded to a relatively narrow width. Generally, the width of a typical strand is that width which is obtained by shredding the sheet-like material at from about 25 cuts per inch to about 60 cuts per inch, preferably from about 30 cuts per inch to about 45 cuts per inch. Such strands have widths ranging from about 1/25 inch to about 1/60 inch, preferably from about 1/30 inch to about 1/45 inch.

The width of the strip of sheet-like material can vary, and typically is a width capable of being shredded to form at least a portion of the strands which are further employed in providing the rod. The total width of the strip employed in providing strands for the formation of a desired rod can depend upon factors such as the thickness of the sheet-like material, the number of strands desired, the nature or character of the strands produced (i.e., straightened or elongated versus crimped or wavy), the surface character of the material (i.e., a fibrous surface character versus a smooth surface), the porosity of the material, and other such factors. For example, a rod having 320 strands each 1/32 inch in width and produced from sheet-like material can be provided either from a roll of sheet-like material having a width of 10 inches or from 2 rolls of sheet-like material each having a width of 5 inches. For most applications of this invention, sheet-like material providing a total width of from about 7 inches to about 15 inches, preferably from about 8 inches to about 12 inches, can be employed. Furthermore, for most applications of this invention, typical rods have circumferences which range from about 20 mm to about 26 mm and contain more than about 175 generally longitudinally extending strands.

Referring to FIG. 1, rod making apparatus 2 includes source 5 of sheet-like material 8 and 9, shredding means 12 for providing a plurality of generally aligned continuous strands 15, and rod-forming means 18. The rod-forming means or unit is positioned on a machine frame, table, or machine "bed" 19 which can be a conventional machine frame for the manufacture of cigarette rods or cigarette filter rods. In operation, the sheet-like material 8 and 9 in the form of strips is passed through the shredding means 12 and the resulting strands 15 formed thereby are introduced into the rod-forming means 18 thereby forming continuous rod 20, which can be subdivided by severing means 22 into a plurality of rods 24 which are collected using collection means 27.

More particularly, the source of sheet-like material includes rotatable bobbins 30 and 31, or other such means capable of providing long strips of sheet-like material. The bobbins are held in place using bobbin holders 33 and 34 cooperating with bobbin supporting and positioning device 38 of frame 40. The frame 40 is manufactured from material such as metal and can be conveniently mounted on machine frame 19. Typically, each rotatable bobbin is provided in the form of a roll of sheet-like material. As shown in FIG. 1, the two bobbins are positioned in tandem (i.e., the rolls are positioned in a diametrical plane relationship) such that strip of sheet-like material 8 which is removed from bobbin 30 overlies strip of sheet-like material 9 which is removed from bobbin 31. Depending upon the positioning of the bobbin, the strip can be removed from the top portion of the bobbin (as shown in FIG. 1) or the bottom portion of the bobbin. Depending upon the width of each roll, one or more rolls can be positioned as a bobbin on the frame. If desired, the bobbins can be positioned in a coaxial relationship relative to one another.

The strips of sheet-like material are removed from the rolls and fed through shredding means 12 such that the strips are shredded to form a plurality of continuously extending strands 15 of the desired width. Examples of suitable shredding means are described in U.S. Pat. Nos. 4,411,391 to Crane, and 4,489,897 to Turner et al, both of which are incorporated herein by reference. A suitable shredding means includes two rotatable shredding rollers or cutter assemblies 43 and 44. Each shredding roller has a plurality of coaxial, spaced apart, circular cutter disks or cutting wheels 47 and 48. The cutter disks of each shredding roller are positioned so as to enter the gap between the spaced apart cutter disks of the opposing shredding roller. The shredding rollers are rotated in opposite directions such that the overlapping cutter disks collectively act to cut the sheet-like material fed into the nip of the shredding rollers into a plurality of strands 15. The cutter disks can overlap the opposing cutter disks (i.e., enter the gap formed by two opposing spaced apart cutter disks) in an amount which can vary. For example, for circular cutter disks having a diameter of 4 inches, overlap of the opposing rows (as measured along the diameter of disks) of up to about 0.5 inch, preferably about 0.25 inch is useful for most applications. The overlap between the opposing rows of cutter disks is believed to provide strands having a crimped character. The two shredding rollers each include a plurality of stripper means 51 and 52 positioned on each roller between each of the spaced apart cutter disks. The stripper means can have a substantially elongated shape and typically acts to prevent jamming of shredded material in the regions between the various cutter disks. Alternatively, a comb-like means or other such means positioned between each of the cutter disks can be employed to prevent jamming of shredded material.

The shredding means 12 is mounted on and secured to support means 55 of frame 40 and is positioned such that strips 8 and 9 of sheet-like material can be fed through the nip of the two shredding rollers 43 and 44, and the resulting plurality of strands 15 can be fed into the rod-forming means 18. The shredding means can be secured to frame 40 by means such as bolts, spot welds, a pillow block type assembly, or the like.

The shredding rollers are rotated by an adjustable speed drive unit 58 having drive means such as chain or belt 60 connected to a drive means such as gear assembly (not shown) of the shredding means 12. Preferably, the power source (not shown) for the adjustable speed drive is a variable speed electric motor having a drive means providing the ability to drive the adjustable speed drive unit 58 while simultaneously operating and controlling the speed of rod-forming means 18.

The plurality of strands pass from the shredding means and extend therefrom so as to be capable of being introduced into rod-forming means or unit 18. The transfer of the plurality of substantially aligned strands to the rod-forming unit can be assisted by the use of transport tray 65 which is held in place by attachment to frame 40. Alternatively, the transport tray can be a conveyer belt assembly, a transport roller system, or the like. The transport tray 40 is positioned beneath the shredding means such that the resulting plurality of strands can be deposited on the transport tray and transferred in a substantially aligned manner to the rod-forming unit. Preferably, the transport tray forms a generally trapezoidal or generally triangular shape, extending from a width which approximates that of the cutting face of the shredding means to a width which approximates the cross sectional size of gathering means 68 of the rod-forming unit.

The plurality of strands are directed into gathering means 68 of the rod-forming unit 18. The gathering means can have a tongue and horn configuration, a gathering funnel configuration, a stuffer or transport jet configuration, or the like. The gathering means provides for the gathering, conversion or formation of the plurality of strands into a cylindrical (i.e., rod-like) shape whereby the various continuously extending strands are aligned substantially with the longitudinal axis of the cylinder so formed.

The various strands are received into the rod-forming unit and compressed into the form of a cylindrical composite. The cylindrical composite is fed into wrapping mechanism 72 which includes endless garniture conveyer belt 75. The garniture conveyer belt is constructed from woven material, a woven web, or the like. The garniture conveyer belt is continuously and longitudinally advanced using advancing mechanism 78 such as a cooperating drum so as to transport the cylindrical composite through wrapping mechanism 72. The wrapping mechanism provides a strip of wrapping material 80 to the outer surface of the cylindrical composite of strands in order to produce continuous wrapped rod 20.

In operation, the shredding means can effect some movement of the plurality of strands towards the rod-forming means. However, movement of the strands through the rod-forming means is most desirably controlled by the speed at which the garniture conveyer belt travels therethrough. The plurality of substantially aligned continuous strands move toward the rod-forming means at a speed which can vary relative to the speed at which the strands travel through the rod-forming unit as provided by the garniture conveyer belt. For example, strands traveling through the rod-forming unit at a higher speed than that speed at which the strands leave the shredding apparatus can tend to provide elongated or straightened strands; while an overly high speed of strands traveling through the rod-forming means relative to the speed at which the strands leave the shredding apparatus can tend to provide an undesirable breakage of strands during manufacture. Conversely, for example, strands traveling through the rod-forming means at a slightly lesser speed than that speed at which the strands leave the shredding apparatus can tend to provide crimped strands (i.e., somewhat bent, wrinkled, wavy or sinusoidal shaped strands) capable of providing increased quantity of material per unit length of rod section.

The strip of wrapping material is provided from rotatable bobbin 82. The wrapping material can be a variety of materials including conventional cigarette paper, air permeable (i.e., porous) paper plug wrap, air impermeable (i.e., nonporous) paper plug wrap, sheet-like tobacco containing material, and the like. The wrapping material is drawn from the bobbin, is trained over guide rollers 85 and 86, and enters the wrapping mechanism 72 of the rod-forming means. The endless garniture conveyer belt 75 transports both the strip of wrapping material and the cylindrical composite of strands in a longitudinally extending manner through the wrapping mechanism 72 while draping or enveloping the wrapping material about the cylindrical composite. The seam formed by an overlapping marginal portion of wrapping material has adhesive (e.g., hot melt adhesive) applied thereto at applicator region 87 in order that the wrapping material can form a tubular container for the plurality of strands. The adhesive can be cooled using chill bar 88 in order to cause rapid setting of the adhesive. It is understood that various other sealing means and other types of adhesives can be employed in providing the continuous wrapped rod.

The continuous wrapped rod passes from the sealing means and is subdivided (e.g., severed) at regular intervals at the desired, predetermined length using cutting means 22 such as a rotary cutter, a highly sharpened knife, or the like. It is particularly desirable that the cutting means not flatten or otherwise adversely affect the shape of the rod. The succession or plurality of rods 24 are collected for use in collection means 27 which is a tray, a rotary collection drum, or the like. If desired, the rods can be transported directly to a cigarette making machine.

Figure 2:
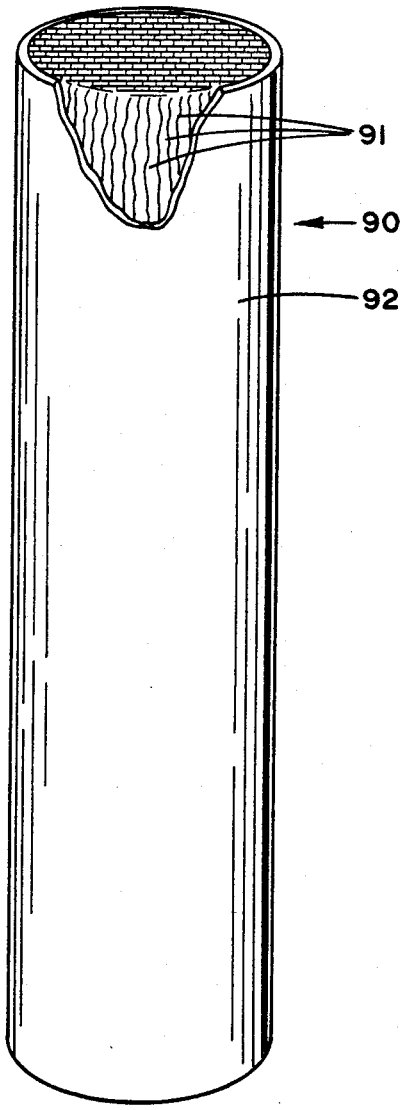
FIG. 2 is a perspective of a rod showing the plurality of substantially longitudinally extending strands provided from sheet-like material, and the circumscribing wrap shown as partially cut away.

Referring to FIG. 2, rod 90 has a substantially cylindrical shape. Preferably, the ends of the rod each form a plane perpendicular to the longitudinal axis thereof. The rod includes a plurality of longitudinally extending strands 91 which are provided from sheet-like material. As shown in FIG. 1, the strands 91 extend generally along the longitude of the rod. The strands are contained in a wrapping material 92 such as cigarette paper wrap or paper plug wrap which is formed in a tubular shape around the strands.

The collected rods are suitably employed in the manufacture of cigarette rods. Typical cigarette rod sizes range in length from about 55 mm to about 85 mm, and from about 20 mm to about 26 mm in circumference. For example, a typical rod having a 57 mm length and a 24.85 mm circumference exhibits a pressure drop of about 40 mm to about 80 mm of water as determined as described previously. One method for controlling the pressure drop of such a rod involves producing strands having a crimped character and positioning the individual strands in a longitudinally extending manner such that air can flow longitudinally through the rod in the the spaces between the strands. When the collected rods are used for the manufacture of cigarette rods, the longitudinally extending strands are provided from a smokable sheet-like material.

Alternatively, the collected rods are suitably employed in the manufacture of cigarette filter elements. For example, the rods can be cut to the desired size resulting in cylindrical filter elements for the manufacture of filter cigarettes. Typical rod sizes for use in the manufacture of filter elements range in length from about 80 mm to about 120 mm, and from about 20 mm to about 26 mm in circumference. For example, a typical rod having a 100 mm length and 24.53 mm circumference exhibits a pressure drop of from about 200 mm to about 400 mm of water as determined at an airflow rate of 17.5 cc/sec using an encapsulated pressure drop tester, sold commercially as Model No. FTS-300 by Filtrona Corporation. One method for controlling the pressure drop o such a rod involves producing strands having a crimped character and positioning the individual strands in a longitudinally extending manner such that air can flow longitudinally through the rod in the spaces between the strands.

Figure 3:
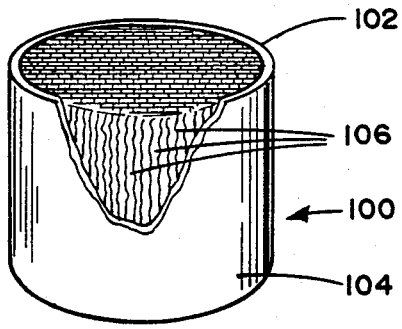
FIG. 3 is a perspective of a cigarette filter element provided from a rod showing the plurality of substantially longitudinally extending strands provided from sheet-like material, and the circumscribing wrap shown as partially cut away.

Referring to FIG. 3, filter element 100 has a substantially cylindrical shape. Preferably, the ends of the plug each form a plane perpendicular to the longitudinal axis thereof. The filter element includes filter medium 102 which is overwrapped (i.e., enveloped) along the longitudinally extending surface with circumscribing wrap material 104. The filter medium includes a plurality of generally longitudinally extending strands 106 provided from sheet-like material. The filter element has a longitudinally extending length and circumference comparable to the length and circumference of a filter element employed in the manufacture of a conventional cigarette.

Typical filter elements of this invention exhibit good firmness and good integrity. In particular, it is desirable that the various strands not readily fall out of the ends of the filter element. The filter elements exhibit a firmness value of less than 10 units characteristic of a cylindrical rod shaped element having a circumscribing paper wrap, a length of about 100 mm and circumference of about 24.5 mm as measured at 76° F. and 60 percent relative humidity using a Cigarette Firmness Tester Model No. CFTA supplied by Fairchild Industries, Winston-Salem, N.C. As used herein, the term "units" in referring to the firmness value represents each 0.1 mm of vertically measured depression exhibited by the filter element when subjected to a force in the form of a load supplied transversely to the longitudinal axis thereof (i.e., the direction of the force supplied by the load is perpendicular to the longitudinal axis of the filter element). The depression exhibited by the filter element is determined by subjecting a 1 inch diameter, flattened stainless steel testing pad equipped with a load (total weight thereof is about 20 g) which rests on the filter element to the force provided by a 205 g load which is placed on the testing pad for a period of 5 seconds. A low measured firmness value represents a high firmness of the sample. Preferably, the firmness value of the filter elements is less than about 5, more preferably between about 3 and about 5, for elements evaluated as described hereinbefore.

Figure 4:
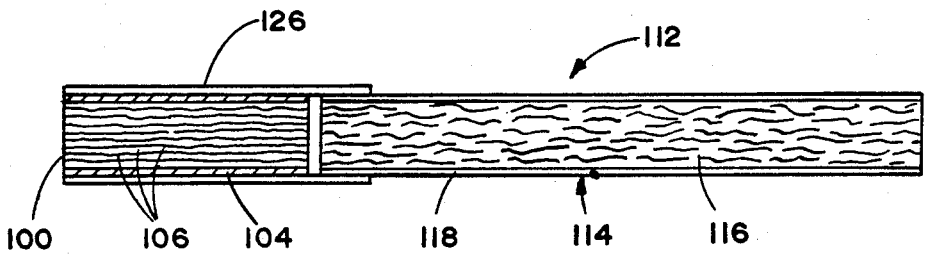
FIG. 4 is a diagrammatic cross sectional illustration of a cigarette showing the rod of smokable material, and the axially aligned filter element having strands which extend generally along the longitude thereof.

An embodiment of this invention shown in FIG. 4 is a smoking article in the form of a cigarette 112. The cigarette includes a generally cylindrical rod 114 of smokable material 116 contained in a wrapping material 118. Typically, the smokable material is a charge of cured or processed tobacco, reconstituted tobacco, tobacco substitute, or blend thereof. The smokable material generally is material conventionally employed in the manufacture of cigarettes (i.e., as strands of material about 1/32 inch wide and treated with conventional additives such as humectants and flavorants). Typically, the wrapping material is a conventional cigarette wrapping paper. The ends of the rod are open to expose the smokable material. Rod 114 has a circumference comparable to that of conventional cigarettes and has a longitudinally extending length comparable to the tobacco rod length of conventional cigarettes. The smoking article further includes previously described filter element 100 positioned adjacent to one end of rod 114 such that the filter element is axially aligned with the rod in an end-to-end relation. Filter element 100 has a substantially cylindrical shape, a plurality of longitudinally extending strands 106, a circumscribing wrap 104, and the diameter of the rod is substantially equal to the diameter of the filter element. Preferably, the filter element substantially abuts the rod. The ends of the filter element are open to permit the passage of air and smoke. Preferably, the filter element has a longitudinally extending length which ranges from about 19 mm to about 31 mm. Filter element 100 is attached to rod 114 by tipping material 126 which circumscribes both the filter element and an adjacent region of the rod. The inner surface of the tipping material is fixedly secured (e.g., using an adhesive) to the outer surface of the filter element and to the wrapping material of an adjacent region of the rod. The tipping material circumscribes the rod over a longitudinal length which can vary but is typically that length sufficient to provide good attachment of the filter element to the rod. The tipping material can be either a conventional air permeable tipping material or a conventional substantially air impermeable tipping material. Typically, the tipping material is tipping paper. If desired, openings such as slits, holes, or perforations in the substantially air impermeable tipping material and the plug wrap can provide a means for air dilution of the smoking article.

Figure 5:
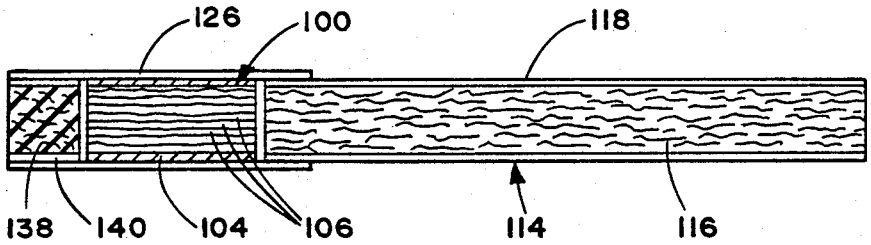
FIG. 5 is a diagrammatic cross sectional illustration of a cigarette showing aligned in sequence the rod of smokable material, the filter element having strands which extend generally along the longitude thereof, and the second filter element of another configuration.

An embodiment of this invention shown in FIG. 5 is a smoking article in the form of a cigarette 127 having a generally cylindrical rod 114 of smokable material 116 contained in wrapping material 118. The smoking article further includes the previously described filter element 100 having a plurality of longitudinally extending strands 106 overwrapped with a circumscribing wrap material 104. Filter element 100 is axially aligned with the rod in an end-to-end relation, has a substantially cylindrical shape, has a diameter which is substantially equal to that of the rod, and preferably substantially abuts the rod. The smoking article further includes a second filter element 138 which is axially aligned with filter element 100. Optionally, the second filter element is overwrapped with a circumscribing wrap material 140 such as a conventional filter plug wrap, or the like. Second filter element 138 is axially aligned with filter element 100 in an end-to-end relation, has a substantially cylindrical shape, has a diameter in combination with the optional wrap material which is substantially equal to that of the rod, and preferably substantially abuts the filter element 100. Second filter element 138 can be conventional tow material such as cellulose acetate, or the like. Second filter element 138 can have a generally fibrous character, a molded shape, or other such configuration. The longitudinal length of second filter element 138 relative to the longitudinal length of filter plug 100 can vary depending upon the application desired. The filter region (i.e., axially aligned filter element 100 and second filter element 138) is attached to rod 114 by tipping material 126 which circumscribes both the filter elements and an adjacent region of the rod.

If desired, another embodiment of the cigarette shown in FIG. 5 can be a rod of smokable material aligned in an end-to-end relationship with a filter element such as the previously described, so called second filter element. The filter element containing the strands provided from sheet-like material is aligned in an end-to-end relationship with the second filter element such that the rod, the so called second filter element and filter element of this invention are positioned in sequence. The filter elements can be attached to the rod using tipping material.

It is understood that the particular embodiments described herein are only illustrative of the principles of this invention, and that various modifications can be made by those skilled in the art without departing from the scope and spirit of this invention. For example, ovoidal shaped filter elements and cigarettes can be manufactured.

The following example is provided in order to further illustrate the invention but should not be construed as limiting the scope thereof. Unless otherwise noted, all parts and percentages are by weight.

EXAMPLE

An apparatus generally shown in FIG. 1 is provided.

A cigarette filter rod making unit known as a PM-2 Filter Maker by Molins Machine Co., Ltd., Deptford, England is provided as a machine bed. To this unit is attached a metal frame supporting two bobbins of sheet-like material, a shredding means and a transport tray. The frame includes four vertically extending metal rods which support the shredding means about 18 inches above the top surface of the bed. A horizontally extending portion of the frame extends from the vertically extending rods in order to support two bobbins of sheet-like material. The center of each bobbin is positioned about 29 inches above the surface of the bed, and the two bobbins are positioned in tandem with the centers thereof about 23 inches apart. The bobbin holders are axle-like means which rest in grooves in the horizontally extending portion of the frame.

The bobbins are each rolls of sheet-like reconstituted tobacco material. The rolls each contain about 3,000 meters of sheet-like material and are about 22 inches in diameter. The sheet-like material is in the form of a strip having a width of about 5 inches. The sheet-like material contains about 67 percent tobacco, and about 33 percent wood pulp (based on dry weight of the material). The moisture content of the material is about 8.8 percent. The material has a dry tensile strength of 5.1 pounds per 27 mm as determined by Thwing Albert Model QC II Tensile Tester, a basis weight of 45 g/square meter as determined by TAPPI Standard T 410, and 31.5 percent tobacco character extractables as determined by ATF Procedure 73-5.

The two strips of sheet-like material are removed from the respective bobbins and are positioned such that one strip overlies the other. The two strips so provided are fed into the shredding means which is a commercially available paper slitting machine having two intermeshing cutting rolls capable of providing strands at 32 cuts per inch from the strips of sheet-like material. The cutter disks of the cutting rolls are circular, and each has a thickness of about 0.029 inch and a diameter of about 2 inches. The two intermeshing cutting rolls overlap by about 0.125 inch (as measured along the diameter of the disks). The shredding means is sold commercially as Destroy-It Papershredder Series 50, 1/32 Inch Cut, Superspeed Table Model, by Electric Wastebasket Corporation, New York, N.Y., USA. The cutting rolls extend longitudinally in order to provide a cutting region of about 9 inches.

The shredding means is operated by a drive means powered by a P.I.V.® Positively Infinitely Variable Drive from Link Belt Company. The shredding means is operated at an rpm which provides a peripheral blade speed approximately equal to (but very slightly greater than) the speed of the endless garniture conveyer belt.

The strips pass through the nip of the cutting rolls resulting in the formation of about 320 independent strands. The plurality of individual strands are directed to a tongue and horn configuration of a rod-forming unit by a transport tray. The transport tray is an aluminum metal, generally trapezoidal shaped sheet positioned about 2 inches below the shredding means and extends to the rod forming unit. The width of the transfer tray is about 10 inches at the point beneath the shredding means, and about 1 inch at the point near the tongue and horn configuration of the rod-forming unit. The length of the transport tray as measured from beneath the shredding means to near the rod-forming unit is about 26 inches. The transport tray includes vertically extending sides (about 1 inch high) in order to maintain the strands in a substantially aligned configuration within the confines of the tray.

The strands enter the rod-forming unit which is positioned on the surface of the PM-2 bed. The strands are received and gathered into a generally cylindrical shape and are aligned along the longitudinal axis of rod so formed. The plurality of individual strands in a rod-like shape are wrapped in porous paper plug wrap commercially available as Ecusta 646 Plug Wrap. The wrap is maintained in a tubular manner about the strands by the application of a hot melt adhesive. The continuous rod so provided is produced at a rate of about 400 feet per minute.

The continuous rod is cut into cylindrical segments with the ends thereof perpendicular to the longitudinal axis of the rod. Each resulting rod has a length of 100 mm, a circumference of 24.6 mm, a weight of 1.4 g, and a pressure drop of 250 mm of water as determined at an airflow rate of 17.5 cc/sec using an encapsulated pressure drop tester sold commercially as Model No. FTS-300 by Filtrona Corporation. The individual strands exhibit a crimped (i.e., randomly folded) configuration, and nonbroken strands extend over the total length of the rod. The amount of crimp per strand is such that, on the average, a strand which extends from end to end in a 100 mm rod exhibits an elongated length of about 115 mm.

The rods are transferred from the filter tray to a Molins Mark IX cigarette making machine. The rods are each cut into 25 mm length cylindrical filter elements. Each filter element exhibits a pressure drop of 70 mm (as determined using techniques described previously). Each filter element is attached to one end of a conventionally prepared tobacco rod (i.e., a charge of cut filler wrapped in cigarette wrapping paper) having a length of 59 mm and circumference approximately equal to that of the filter element, using nonporous cigarette tipping paper. The tipping paper circumscribes the filter element along the length of the filter element and along about 6 mm of the tobacco rod which abuts one end of the filter element. The tipping paper is secured to the filter element and tobacco rod by applying adhesive to the inner portion of the tipping paper.

The resulting cigarette having a total length of 84 mm and weight of 1.1 g is provided with an air dilution means by providing perforations in the tipping paper and plug wrap using an on-line laser air dilution perforation method. Each cigarette exhibits air dilution of 30.5 percent, delivers 11.4 mg of "tar" as determined under standard U.S. Federal Trade Commission (i.e., FTC) conditions, delivers 0.96 mg nicotine as determined under standard FTC conditions, and exhibits a total pressure drop of 115 mm (as determined using techniques described previously). The cigarettes so provided exhibit an enhanced tobacco taste to the user thereof.

What is claimed is claimed:

1. A filter rod for the preparation of cigarette filter elements, the rod comprising a plurality of individual strands provided from fibrous, nonwoven sheet-like reconstituted tobacco material, wherein the strands extend generally along the longitude of the rod and are contained in a circumscribing wrap, and wherein the width of each individual strand is greater than the thickness thereof.

2. The rod of claim 1 wherein the length thereof ranges from about 80 mm to about 120 mm; and the circumference thereof ranges from about 20 mm to about 26 mm.

3. The rod of claim 17 wherein the circumscribing wrap is a paper wrap.

4. The rod of claim 3 wherein the paper wrap is an air permeable plug wrap.

5. The rod of claim 3 wherein the paper wrap is an air impermeable plug wrap.

6. The rod of claim 1 wherein the strands have a crimped character.

7. The rod of claim 1 wherein the strands have widths which range from about 1/25 inch to about 1/60 inch.

8. The rod of claim 1 wherein the strands have widths which range from about 1/30 inch to about 1/45 inch.

9. The rod of claim 1 having more than about 175 strands extending generally along the longitude thereof.

10. The rod of claim 1 wherein said reconstituted tobacco material contains greater than about 65 percent by weight of tobacco.

11. A substantially cylindrical cigarette filter element comprising a filter medium and a circumscribing plug wrap, wherein the wrap covers the longitudinally extending surface of the filter medium such that the ends of the filter medium are open in order to permit the passage of air and smoke therethrough, and wherein the filter medium includes a plurality of individual strands which extend along the general longitude of the filter element, which strands are provided from fibrous nonwoven sheet-like reconstituted tobacco material, and the width of each individual strand is greater than the thickness thereof.

12. The filter element of claim 11 wherein the plug wrap is a paper wrap.

13. The filter element of claim 11 wherein the strands have a crimped character.

14. The filter element of claim 11 having a circumference of from about 20 mm to about 26 mm.

15. The filter element of claim 11 having a length of from about 19 mm to about 31 mm.

16. The filter element of claim 11 wherein the nonwoven sheet-like reconstituted tobacco material has a moisture content of less than about 15 percent.

17. The filter element of claim 11 wherein the nonwoven sheet-like reconstituted tobacco material has a moisture content of from about 7 percent to about 12 percent.

18. The filter element of claim 11 having about 320 independent strands.

19. The filter element of claim 18 wherein said strands each have a width of about 1/32 inch.

20. The filter element of claim 11 wherein said reconstituted tobacco material contains greater than about 65 percent by weight of tobacco.

21. The filter element of claim 11 having more than about 175 strands extending generally along the longitude thereof.

22. A cigarette comprising a rod of smokable material axially aligned with and having attached to one end thereof, a substantially cylindrical cigarette filter element having a filter medium and a circumscribing plug wrap, wherein the wrap covers the longitudinally extending surface of the filter medium such that the ends of the filter medium are open in order to permit the passage of air and smoke therethrough, and wherein the filter medium includes a plurality of individual strands, which strands are provided from fibrous, nonwoven, sheet-like reconstituted tobacco material, and the width of each individual strand is greater than the thickness thereof.

23. The cigarette of claim 22 wherein the filter element thereof comprises more than about 175 strands extending generally along the longitude thereof.

24. A cigarette comprising a rod of smokable material axially aligned with and having attached to one end thereof, two filter elements in sequence, one of which filter elements is a substantially cylindrical cigarette filter element having a filter medium and a circumscribing plug wrap, wherein the wrap covers the longitudinally extending surface of the filter medium such that the ends of the filter medium are open in order to permit the passage of air and smoke therethrough, and wherein the filter medium includes a plurality of individual strands, which are provided from fibrous, nonwoven, sheet-like reconstituted tobacco material, and the width of each individual strand is greater than the thickness thereof.

25. The cigarette of claim 24 wherein the filter element which includes the plurality of strands provided from reconstituted tobacco material comprises more than about 175 strands extending generally along the longitude thereof.

26. The cigarette of claim 24 wherein one of the filter elements thereof comprises cellulose acetate tow.

27. The cigarette of claim 26 having aligned in sequence the rod of smokable material, the filter element comprising cellulose acetate and the filter element including the plurality of strands of reconstituted tobacco material.

* * * * *